US009611864B2

(12) United States Patent
Childe et al.

(10) Patent No.: US 9,611,864 B2
(45) Date of Patent: Apr. 4, 2017

(54) CENTRIFUGAL COMPRESSOR

(75) Inventors: Matthew John Childe, Malmesbury (GB); Peter Lee Crossley, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 2145 days.

(21) Appl. No.: 12/709,146

(22) Filed: Feb. 19, 2010

(65) Prior Publication Data

US 2010/0215485 A1 Aug. 26, 2010

(30) Foreign Application Priority Data

Feb. 24, 2009 (GB) ..... 0903050.3

(51) Int. Cl.
*F04D 29/62* (2006.01)
*F04D 29/44* (2006.01)

(52) U.S. Cl.
CPC ..... *F04D 29/444* (2013.01); *F04D 29/624* (2013.01); *F05D 2250/52* (2013.01); *F05D 2300/43* (2013.01); *Y10T 29/49243* (2015.01)

(58) Field of Classification Search
CPC .. F04D 29/444; F04D 29/624; F05D 2250/52; F05D 2300/43
USPC ..... 415/213.1, 214.1, 215.1, 203, 204, 206, 415/152.2, 159, 160
See application file for complete search history.

(56) References Cited

U.S. PATENT DOCUMENTS

| | | | | |
|---|---|---|---|---|
| 4,403,914 A * | 9/1983 | Rogo et al. | ..... | 415/165 |
| 4,611,969 A | 9/1986 | Zinsmeyer | | |
| 4,718,819 A | 1/1988 | Rogo et al. | | |

FOREIGN PATENT DOCUMENTS

| | | |
|---|---|---|
| EP | 0134748 | 3/1985 |
| GB | 2190429 | 11/1987 |
| JP | 54-131104 | 10/1979 |
| JP | 55-49095 | 3/1980 |
| JP | 60-256504 | 12/1985 |
| JP | 1-173301 | 12/1989 |
| JP | 6-193595 | 7/1994 |
| JP | 7-8596 | 2/1995 |
| JP | 2007-224866 | 9/2007 |

OTHER PUBLICATIONS

International Search Report and Written Opinion mailed May 7, 2010, directed towards corresponding International Application No. PCT/GB2010/050209; 12 pages.
GB Search Report dated Jun. 1, 2009, directed at counterpart GB Application No. 0903050.3; 1 Page.

* cited by examiner

*Primary Examiner* — Dwayne J White
(74) *Attorney, Agent, or Firm* — Morrison & Foerster LLP

(57) ABSTRACT

A centrifugal compressor that includes an impeller, a diffuser and a shroud. One of the diffuser and shroud includes a plurality of recesses and the other of the diffuser and shroud includes a plurality of radial vanes. The shroud covers the impeller and diffuser such that each radial vane projects into a respective recess.

18 Claims, 4 Drawing Sheets

CENTRIFUGAL COMPRESSOR

REFERENCE TO RELATED APPLICATIONS

This application claims the priority of United Kingdom Application No. 0903050.3, filed Feb. 24, 2009, the entire contents of which are incorporated herein by reference.

FIELD OF THE INVENTION

The present invention relates to a centrifugal compressor.

BACKGROUND OF THE INVENTION

A known design of centrifugal compressor comprises an impeller and vaned diffuser covered by a static shroud. In order to maximise performance, the clearance between the impeller and the shroud is ideally as small as possible while allowing for minor changes in the impeller and shroud that arise during subsequent use of the compressor. Additionally, no clearance ideally exists between the shroud and the vanes of the diffuser, since any clearance presents a pathway for the working fluid to flow over the vanes without being turned. Owing to manufacturing tolerances, it is generally difficult to reproducibly manufacture a centrifugal compressor having a small, well-defined clearance between the shroud and impeller while simultaneously ensuring that there is no clearance between the shroud and the diffuser vanes.

SUMMARY OF THE INVENTION

In a first aspect, the present invention provides a centrifugal compressor comprising an impeller, a diffuser and a shroud, one of the diffuser and shroud comprising a plurality of recesses and the other of the diffuser and shroud comprising a plurality of radial vanes, wherein the shroud covers the impeller and diffuser such that each radial vane projects into a respective recess.

The shroud and diffuser define a chamber into which a working fluid ejected by the impeller is caused to expand. The radial vanes are located within this chamber and act to turn the expanding fluid. By providing recesses into which radial vanes project, the position of the shroud relative to the diffuser and impeller may be adjusted such that a well-defined clearance between the shroud and impeller is obtained without creating a radial gap between the vanes and the shroud or diffuser. Consequently, a high-performance compressor may be realised.

By adjusting the position of the shroud relative to the diffuser, an axial gap may be created between each radial vane and the shroud or diffuser. Although an axial gap is created, the gap defines a convoluted pathway; there is no direct, radial gap or pathway between the vanes and the shroud or diffuser. Consequently, the working fluid ejected by the impeller impinges upon and is turned by the radial vanes. This is contrast to an arrangement in which a clear radial gap exists between each radial vane and the shroud or diffuser, which would then provide a direct pathway for the working fluid to pass over or under the vane without being turned.

Preferably, the shroud is spaced axially from the impeller by an amount that it is smaller than the axial spacing between each radial vane and the wall defining a respective recess. That is to say that the shroud-impeller clearance is smaller that the axial gap at the top or bottom of each radial vane. This then has the advantage that the shroud may be made to initially contact the impeller. The shroud can then be separated from the impeller by a predetermined amount to create a well-defined clearance.

Advantageously, each radial vane projects axially into a respective recess by a first amount, the shroud is spaced axially from the impeller by a second amount, and each recess has a depth greater than the sum of the first amount and the second amount. Consequently, the shroud may be made to initially contact the impeller and then separated from the impeller to create a clearance, while the vanes continue to project into the recesses.

The shroud may comprise a bell-shaped wall having a central aperture. A first portion then covers the impeller and a second portion covers the diffuser. The inner surface of the first portion is then contoured so as to correspond to the edges of the impeller blades.

The impeller is ideally mounted to a shaft, which is in turn rotatably mounted to the diffuser. By mounting the shaft directly to the diffuser, accurate alignment of the impeller and diffuser is made possible. In particular, the shaft may be mounted to the diffuser such that the rotational axis of the shaft is both concentric and normal to the diffuser.

Preferably, the impeller, the diffuser and the shroud are each formed of plastic, thereby significantly reducing the cost of the centrifugal compressor. Although plastics are generally not capable of the tolerances normally required to ensure a well-defined shroud-impeller clearance, the recesses into which the radial vanes project act to absorb the tolerance stack and thus a well-defined clearance may be achieved using materials that would otherwise be regarded as unsuitable.

In a second aspect, the present invention provides a shroud-diffuser assembly for a centrifugal compressor, the assembly comprising a shroud and a diffuser, one of the shroud and diffuser comprising a plurality of recesses and the other of the shroud and diffuser comprising a plurality of radial vanes, wherein the shroud can be made to cover the diffuser such that each radial vane projects into a respective recess.

The shroud is intended to additionally cover an impeller of the centrifugal compressor. As already noted, by providing recesses into which the vanes project, the shroud may be positioned relative to the impeller so as to obtain a well-defined clearance without creating a radial gap at the top or bottom of each vane.

Advantageously, the shroud can be made to cover the diffuser such that, in addition to projecting into a respective recess, each radial vane is spaced axially from a wall of the respective recess. That is to say that an axial gap advantageously exists at the top or bottom of each radial vane. By having an axial gap at the top or bottom of each vane, there is a degree of play by which the shroud may be positioned relative to the diffuser. Accordingly, the position of the shroud relative to the impeller may be adjusted so as to achieve an optimum or well-defined clearance. Although an axial gap exists at the top or bottom of the each radial, each vane continues to project into a recess and thus there is no radial gap associated with each vane.

The shroud may comprise a bell-shaped wall having a central aperture, a first portion for covering an impeller of the compressor and a second portion for covering the diffuser. Moreover, the shroud may include a support wall that extends from the bell-shaped wall, and a plurality of struts that extend between the support wall and the bell-shaped wall. The struts and support wall then provide good structural support to the bell-shaped wall, which can then be made thinner.

Preferably, the shroud can be directly secured to the diffuser so as to cover the diffuser. Consequently, after the position of the shroud relative to the diffuser has been adjusted to define the clearance between the shroud and impeller, the shroud may be directly secured to the diffuser so as to maintain the clearance.

The diffuser advantageously comprises a hub, a perimeter wall, and a plurality of axial vanes that extend between the hub and the perimeter wall, and the shroud can be made to cover the perimeter wall. Consequently, the shroud and diffuser cooperate to direct the flow of fluid through the assembly from a radial direction to an axial direction. The shroud may comprise a curved downwardly-projecting edge that sits within the perimeter wall of the diffuser. This then has the advantage that the shroud provides a smooth, continuous surface over which the fluid is turned from a radial to axial direction, thereby minimising pressure losses.

The radial vanes are preferably two-dimensional aerofoils, which provide good pressure recovery over a good range of flow rates.

In a third aspect, the present invention provides a shroud for covering an impeller and a diffuser of a centrifugal compressor, the shroud comprising a bell-shaped wall having a central aperture, a first portion covering the impeller and a second portion covering the diffuser, wherein a surface of the first portion is contoured so as to correspond to blade edges of the impeller and a plurality of recesses are formed in a surface of the second portion, each recess dimensioned to receive a portion of a respective radial vane of the diffuser.

In a fourth aspect, the present invention provides a method of assembling a centrifugal compressor comprising: providing an impeller, a diffuser and a shroud, one of the shroud and diffuser comprising a plurality of recesses and the other of the shroud and diffuser comprising a plurality of radial vanes; covering the impeller and the diffuser with the shroud such that the shroud contacts the impeller and each radial vane projects into a respective recess; and separating the shroud from the impeller and the diffuser such that a clearance is defined between the shroud and the impeller and each radial vane continues to project into a respective recess.

Preferably, the method includes mounting the impeller to a shaft and rotatably mounting the shaft to the diffuser. Consequently, the impeller may be accurately aligned relative to the diffuser.

The diffuser advantageously comprises a hub, a perimeter wall, and a plurality of axial vanes that extend between the hub and the perimeter wall, and the method comprises securing the shroud to the perimeter wall. The shroud and diffuser then cooperate to direct the flow of fluid through the compressor from a radial direction to an axial direction. Preferably, the shroud is adhered to the perimeter wall. Consequently, following separation of the shroud from the impeller and diffuser, the shroud can be conveniently secured to the diffuser such that the clearance between the shroud and impeller is maintained. Additionally, an effective seal is created between the shroud and diffuser thereby preventing any pressure losses that might otherwise arise due to leakage.

One or more of the impeller, the diffuser and the shroud may be formed of plastic through the use of a moulding process, e.g. injection or compression moulding. Consequently, the compressor may be manufactured using materials and processes that would otherwise be precluded from use.

Reference herein to the terms 'axial' and 'radial' (e.g. axial gap, axial clearance, axial direction, radial direction) should be understand to mean in directions respectively parallel and normal to the rotational axis of the compressor. Axial and radial vanes should be understood to be mean vanes that act upon fluid moving in axial and radial direction respectively.

BRIEF DESCRIPTION OF THE DRAWINGS

In order that the present invention may be more readily understood, embodiments of the invention will now be described, by way of example, with reference to the accompanying drawings, in which.

DETAILED DESCRIPTION OF THE INVENTION

Figure 1:
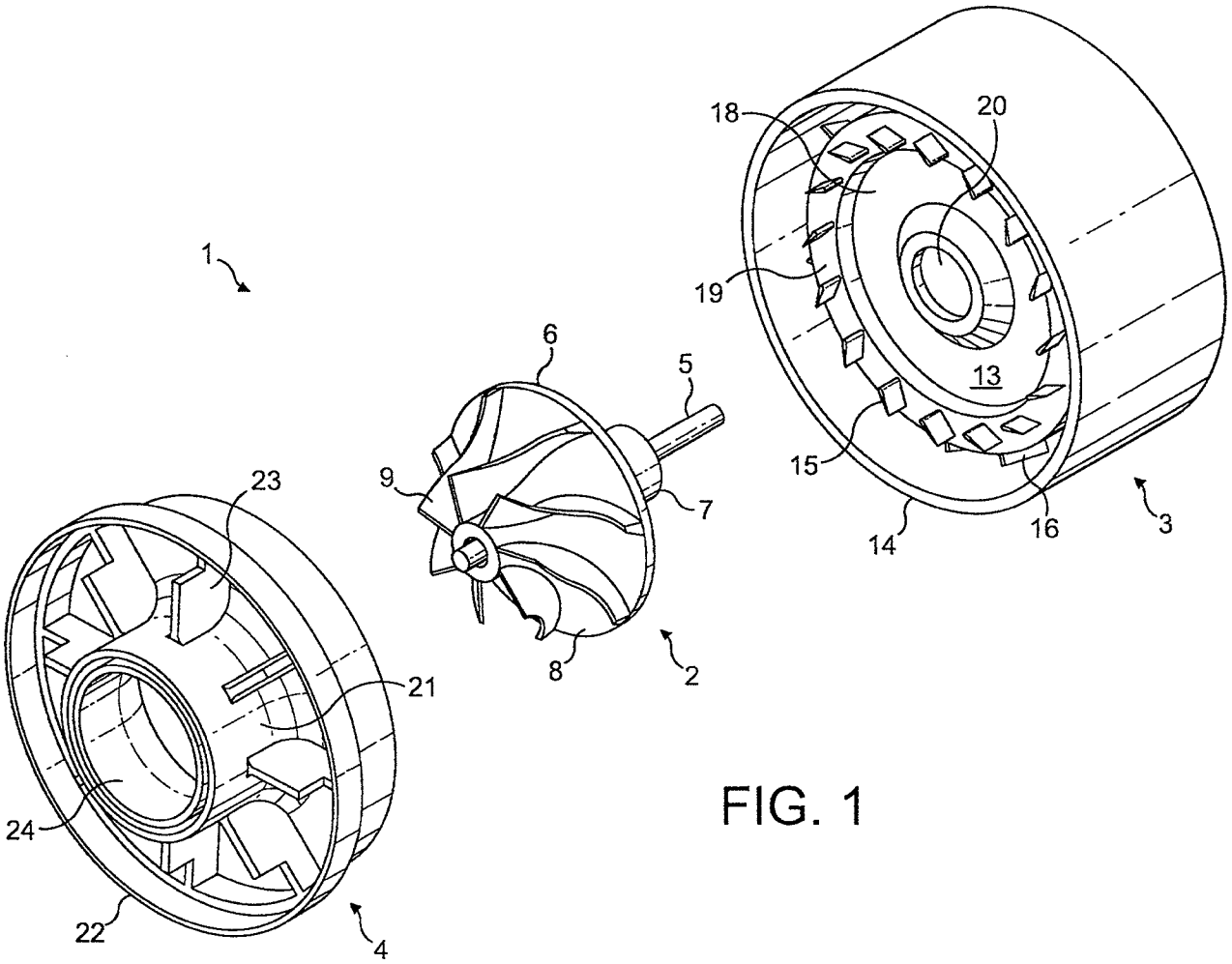
FIG. 1 is a first exploded view of a centrifugal compressor in accordance with the present invention.
Figure 2:
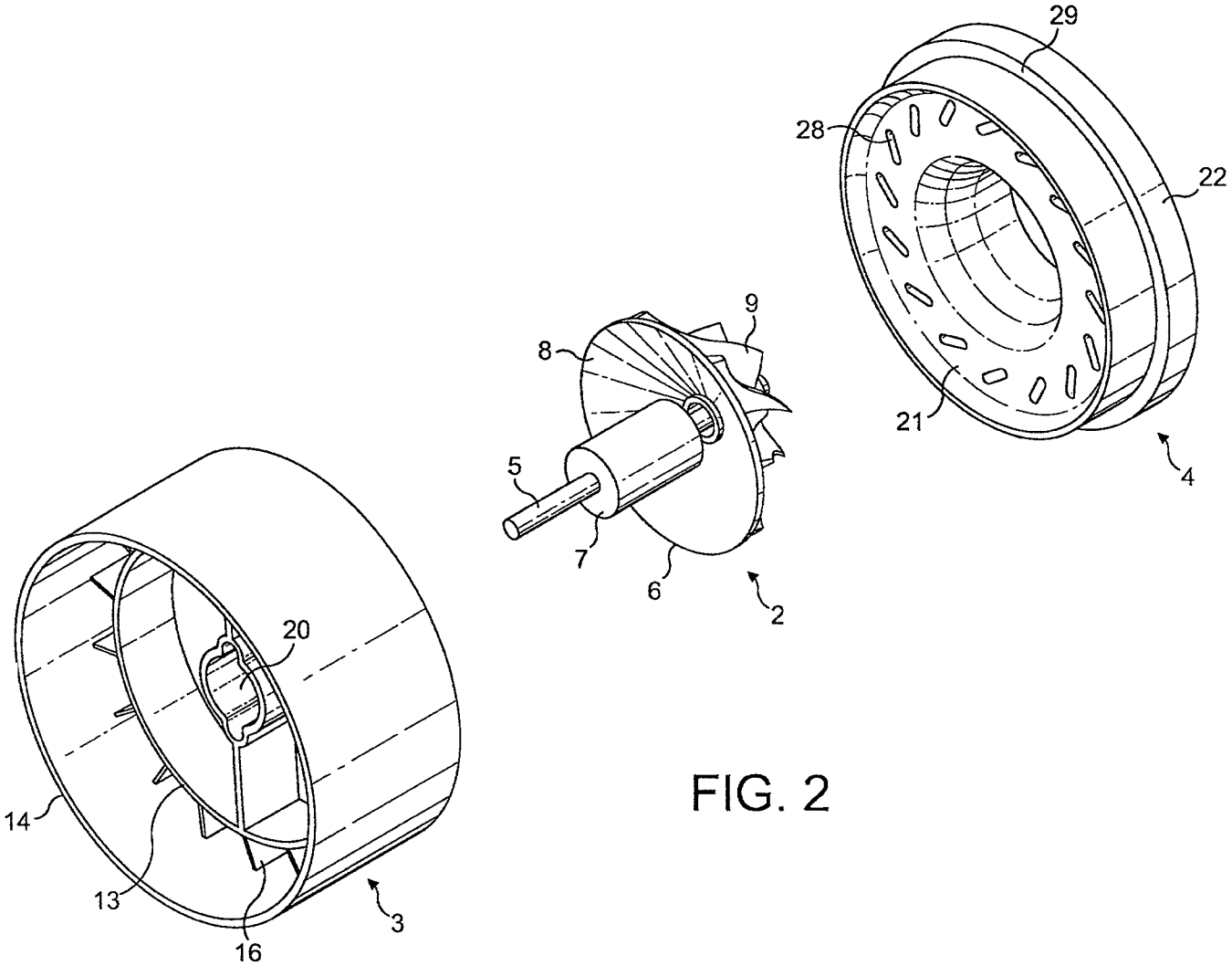
FIG. 2 is a second exploded view of the centrifugal compressor of FIG. 1.
Figure 3:
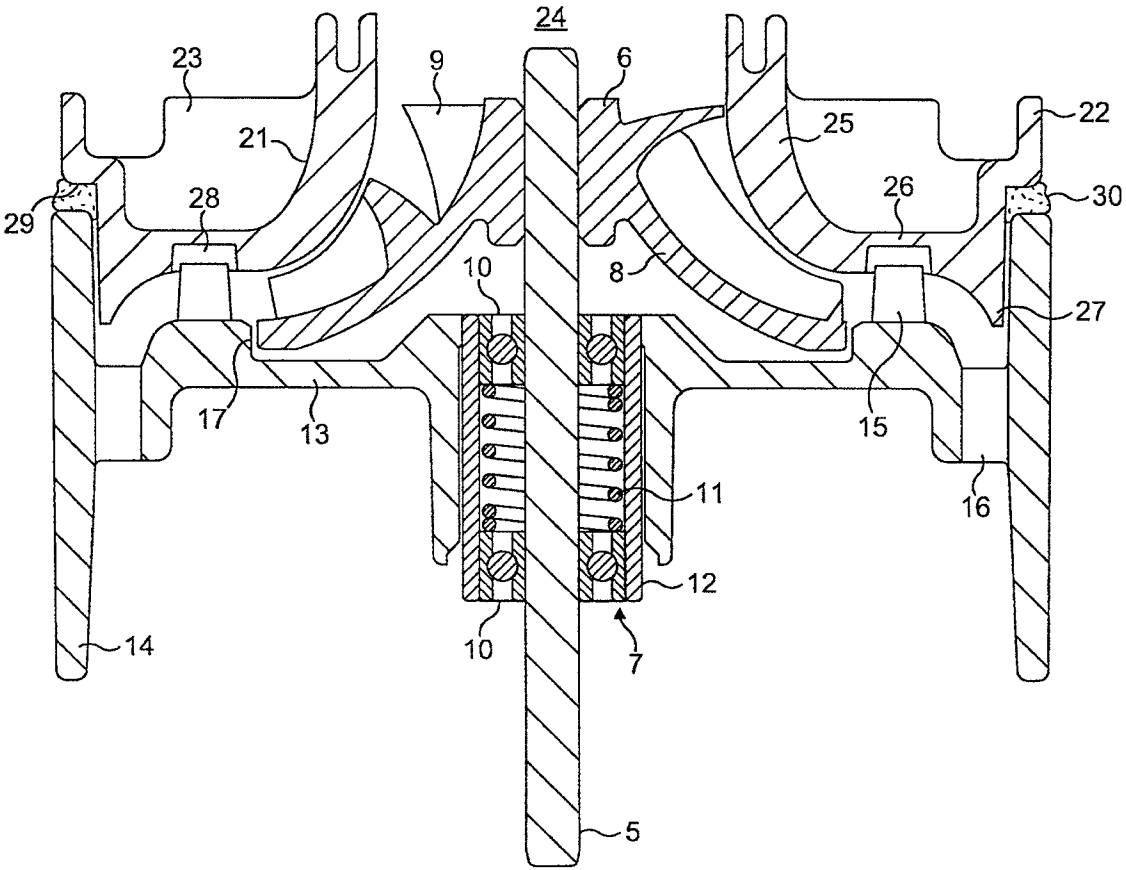
FIG. 3 is a sectional view of the centrifugal compressor of FIGS. 1 and 2.

The centrifugal compressor 1 of FIGS. 1 to 3 comprises a rotor 2, a diffuser 3, and a shroud 4.

The rotor 2 comprises a shaft 5 to which are mounted an impeller 6 and a bearing cartridge 7. The impeller 6 is a semi-open impeller comprising a hub 8 around which a plurality of blades 9 are supported. The bearing cartridge 7 comprises a pair of spaced bearings 10, preloaded by a spring 11, and surrounded by a sleeve 12.

The diffuser 3 comprises a hub 13, a perimeter wall 14, a plurality of radial vanes 15, and a plurality of axial vanes 16. A step 17 is formed in the upper surface of the hub 13 so as to define a central portion 18 and an outer annulus 19. The radial vanes 15 are two-dimensional aerofoils spaced circumferentially around the outer annulus 19. The perimeter wall 14 is spaced from and encircles the hub 13. The axial vanes 16 are two-dimensional aerofoils that extend between and secure the perimeter wall 14 to the hub 13.

The rotor 2 is rotatably mounted to the diffuser 3 by the bearing cartridge 7, which is secured within a central bore 20 in the hub 11 of the diffuser 3.

The shroud 4 comprises a bell-shaped wall 21, an outer support wall 22, and a plurality of struts 23 that extend between the bell-shaped wall 21 and the outer support wall 22.

The bell-shaped wall 21 is annularly symmetric and comprises a central aperture 24 that serves as a fluid inlet, a first portion 25 for covering the impeller 6, and a second portion 26 for covering the diffuser 4. The first portion 25 has an inner surface that is contoured so as to correspond to the top edges of the impeller blades 9. The second portion 26 has an inner surface that includes a planar region extending to curved, downwardly-projecting edge 27.

A plurality of recesses 28 are formed around the inner surface of the second portion 26. Each recess 28 is dimensioned to receive a portion of a respective radial vane 15 of the diffuser 3. In particular, the cross-sectional profile of each recess 28 corresponds to that of a respective radial vane 15. However, the cross-sectional area of each recess 28 is slightly larger than that of a radial vane 15 to account for the tolerance stack, which is discussed below in more detail.

The outer support wall 22 extends upwardly from the perimeter of the bell-shaped wall 21. A step in the diameter of the outer support wall 22 defines an annular ledge 29. The struts 23 extend radially between the bell-shaped wall 21 and the outer support wall 22 to provide structural support.

The shroud 4 is mounted to the diffuser 3 such that it covers both the impeller 6 and the diffuser 3. In particular, the first portion 25 of the shroud 4 covers the impeller 6 and the second portion 26 covers the diffuser 3. The annular ledge 29 of the shroud 4 is secured to the perimeter wall 14 of the diffuser 3 by adhesive 30. A fluid passageway is thus created between the inlet 24 of the shroud 4 and an axial outlet of the diffuser 3. The perimeter wall 14 of the diffuser 3 surrounds the downwardly-projecting edge 27 of the shroud 4. Since the edge 27 of the shroud 4 curves downwardly, the shroud 4 provides a smooth, continuous surface over which the working fluid is turned from a radial to an axial direction, thereby minimising pressure losses.

The shroud 4 is mounted to the diffuser 3 such that a clearance exists between the impeller 6 and the shroud 4. Additionally, each radial vane 15 of the diffuser 3 projects into a respective recess 28 of the shroud 4. The centrifugal compressor 1 thus has a clearance between the shroud 4 and impeller 6 while ensuring that no radial gap exists between the shroud 4 and the radial vanes 15 of the diffuser 3. As will now be described, the manner in which the shroud 4 is mounted to the diffuser 3 ensures that a well-defined clearance is formed between the shroud 4 and impeller 6.

When assembling the centrifugal compressor 1, the rotor 2 is first mounted to the diffuser 3 by securing the bearing cartridge 7 within the bore 20 of the diffuser hub 13. The shroud 4 is then made to cover the rotor-diffuser assembly 2,3 such that the shroud 4 contacts the blades 9 of the impeller 6. This is achieved by mounting the shroud 4 in one half of a jig, mounting the rotor-diffuser assembly 2,3 in another half of the jig (the two halves being coaxially aligned), and bringing the two halves together until the shroud 4 and impeller 6 contact one another. Relative alignment of the shroud 4 and diffuser 3 is achieved such that each radial vane 15 of the diffuser 3 projects into a respective recess 28 of the shroud 4. Each recess 28 is of sufficient depth that the shroud 4 is not prevented from contacting the impeller 6, i.e. when the shroud 4 contacts the impeller 6, each radial vane 15 is spaced axially from the shroud 3 or, to put it another way, an axial gap exists between the top of each radial vane 15 and the shroud 4. Each radial vane 15 projects into a respective recess 28 by an amount that is greater that the eventual shroud-impeller clearance, the advantages of which will shortly become clear. The shroud 4 is then separated from the rotor-diffuser assembly 2,3 by an amount that defines an axial clearance between the shroud 4 and impeller 6. As noted above, prior to separation, each radial vane 15 projects into a respective recess 28 by an amount greater that the shroud-impeller clearance. Consequently, following separation, each radial vane 15 continues to project into a respective recess 28. Finally, an adhesive 30 is applied to the annular gap formed between the ledge 29 of the shroud 4 and the perimeter wall 14 of the diffuser 3. The adhesive 30 is left for a time to wick and cured to create a seal between the shroud 4 and diffuser 3.

There are dimensional and geometric tolerances associated with the manufacture and assembly of the centrifugal compressor 1. For example, there are dimensional tolerances associated with the width, height and stagger angle of a particular radial vane 15, and geometric tolerances associated with the alignment of the diffuser 3 and shroud 4. In order that each radial vane 15 is free to project into a respective recess 28, the cross-sectional area of each recess 28 is greater than that of the respective radial vane 15 by at least an amount that accounts for the tolerance stack. Similarly, the depth of each recess 28 is greater than the sum of the vane projection length (i.e. the distance by which a radial vane 15 projects axially into a respective recess 28) and the shroud-impeller clearance (i.e. the distance by which the shroud 4 is spaced axially from the impeller 6) by at least an amount that accounts for the tolerance stack.

Although a small gap exists between the top of each radial vane 15 and the shroud 4 of the assembled centrifugal compressor 1, the gap defines a convoluted pathway; there is no direct, radial pathway between the vanes 15 and the shroud 4. Consequently, the working fluid ejected by the impeller 6 impinges upon and is turned by the radial vanes 15. This is contrast to an arrangement in which a clear radial gap exists between the top of a vane and the shroud, which then provides a direct, radial pathway for the working fluid to pass over the top of the vane without being turned.

In the embodiment described above, the diffuser 3 has both radial vanes 15 and axial vanes 16. However, it is not essential that the diffuser 3 has axial vanes 16. Moreover, it is not essential that the diffuser 3 or the centrifugal compressor 1 has an axial outlet. The centrifugal compressor 1 might, for example, include a scroll or other collector (not shown). Nevertheless, the shroud 4 continues to cover the impeller 6 and the diffuser 3 such that the radial vanes 15 of the diffuser 3 project into the recesses 28 of the shroud 4.

The diffuser 3 described above is a cascade diffuser having a single row of radial vanes 15. Equally, however, the diffuser 3 may have a plurality of rows of radial vanes; the shroud 4 would then include a corresponding number of rows of recesses. Moreover, the diffuser 3 may be a channel diffuser rather than a cascade diffuser.

The shroud 4 described above includes a second portion 26 having a planar region that extends parallel to the upper surface of the hub 13 of the diffuser 3. Alternatively, the second portion 26 may be inclined and/or curved relative to the hub 13 so as to achieve different flow volume expansion.

Figure 4:
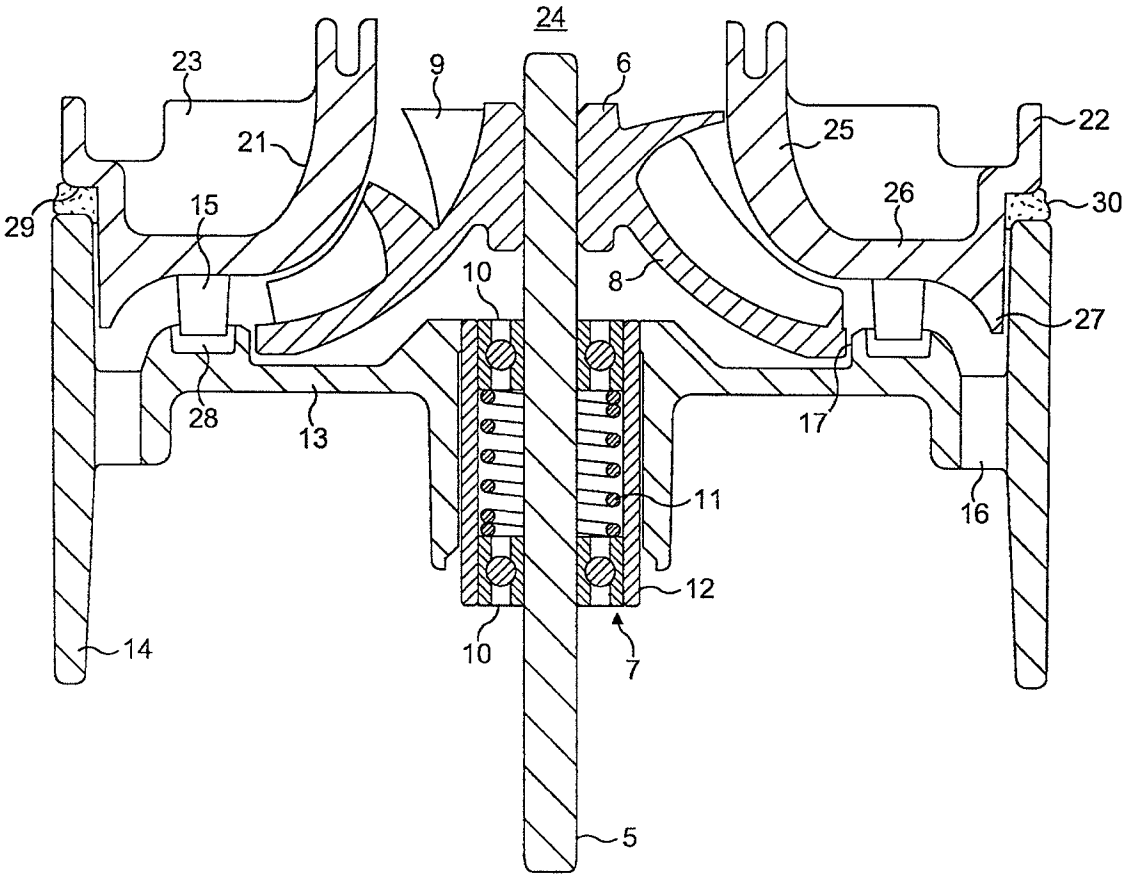
FIG. 4 is a sectional view of an alternative centrifugal compressor in accordance with present invention.

In the embodiment described above, the diffuser 3 comprises a plurality of radial vanes 15 and the shroud 4 comprises a plurality of recesses 28. FIG. 4 illustrates an alternative embodiment in which the shroud 4, rather than the diffuser 3, comprises the plurality of radial vanes 15 and the diffuser 3, rather than the shroud 4, comprises the plurality of recesses 28. The radial vanes 15 are spaced circumferentially around the inner surface of the second portion 26 of the shroud 3, and the recesses 28 are formed around the outer annulus 19 of the hub 13 of the diffuser 3. In all other respects, the centrifugal compressor 1 and the method of manufacturing and assembling the centrifugal compressor 1 are unchanged.

With conventional centrifugal compressors, tolerance stack-up typically results in a variance in the shroud-impeller clearance or a sizeable gap between the shroud and diffuser vanes. Accordingly, high-precision manufacturing is required to ensure that the tolerance stack is kept within acceptable limits. The use of high-precision manufacturing, however, increases the cost of the centrifugal compressor. Moreover, certain materials that may have desirable characteristics (e.g. in terms of weight, strength, thermal characteristics and cost) are precluded from use since it is not possible to manufacture the necessary components at the required tolerances.

With the centrifugal compressor 1 of the present invention, the problem of tolerance stack-up is addressed through the provision of recesses 28 into which diffuser vanes 15 project. The recesses 28 are dimensioned such that the vanes 15 are free to project into the recesses 28 by an amount that absorbs the tolerance stack. The present invention therefore provides a cheaper and simpler method of reproducibly manufacturing a centrifugal compressor 1 having a well-defined shroud-impeller clearance while simultaneously ensuring that no radial gap exists between the diffuser vanes and the shroud. Moreover, the present invention enables the use of manufacturing processes and materials that would otherwise result in unacceptable tolerances. In particular, each of the impeller 6, diffuser 3 and shroud 4 may be formed of a plastic material obtained by compression or injection moulding.

The invention claimed is:

1. A centrifugal compressor comprising an impeller, a diffuser and a shroud, one of the diffuser and shroud comprising a plurality of recesses and the other of the diffuser and shroud comprising a plurality of radial vanes, wherein the shroud covers the impeller and diffuser such that each radial vane projects into a respective recess, wherein each radial vane is spaced axially from a wall of the respective recess, and wherein the shroud is spaced axially from the impeller by an amount smaller than the axial spacing between each radial vane and the wall of the respective recess.

2. The centrifugal compressor of claim 1, wherein the impeller is a semi-open impeller comprising a hub around which a plurality of blades is supported.

3. The centrifugal compressor of claim 1, wherein the shroud comprises a bell-shaped wall having a central aperture, a first portion covering the impeller and a second portion covering the diffuser, wherein a surface of the first portion is contoured so as to correspond to blade edges of the impeller.

4. A centrifugal compressor comprising an impeller, a diffuser and a shroud, one of the diffuser and shroud comprising a plurality of recesses and the other of the diffuser and shroud comprising a plurality of radial vanes, wherein the shroud covers the impeller and diffuser such that each radial vane projects into a respective recess, wherein each radial vane projects axially into a respective recess by a first amount, the shroud is spaced axially from the impeller by a second amount, and each recess has a depth greater than the sum of the first amount and the second amount.

5. A centrifugal compressor comprising an impeller, a diffuser and a shroud, one of the diffuser and shroud comprising a plurality of recesses and the other of the diffuser and shroud comprising a plurality of radial vanes, wherein the shroud covers the impeller and diffuser such that each radial vane projects into a respective recess, wherein the diffuser comprises a hub, a perimeter wall, and a plurality of axial vanes that extend between the hub and the perimeter wall, and the shroud is mounted to the diffuser around the perimeter wall.

6. A centrifugal compressor comprising an impeller, a diffuser and a shroud, one of the diffuser and shroud comprising a plurality of recesses and the other of the diffuser and shroud comprising a plurality of radial vanes, wherein the shroud covers the impeller and diffuser such that each radial vane projects into a respective recess, wherein the impeller, the diffuser and the shroud are each formed of plastic.

7. A shroud-diffuser assembly for a centrifugal compressor, the assembly comprising a shroud and a diffuser, one of the shroud and diffuser comprising a plurality of recesses and the other of the shroud and diffuser comprising a plurality of radial vanes, wherein the shroud is made to cover the diffuser such that each radial vane projects into a respective recess, wherein each radial vane is spaced axially from a wall of the respective recess, and wherein the shroud is spaced axially from the impeller by an amount smaller than the axial spacing between each radial vane and the wall of the respective recess.

8. The assembly of claim 7, wherein the shroud is made to cover the diffuser such that each radial vane is spaced axially from a wall of the recess.

9. The assembly of claim 7, wherein the shroud comprises a bell-shaped wall having a central aperture, a first portion for covering an impeller of the centrifugal compressor and a second portion for covering the diffuser, and a surface of the first portion is contoured so as to correspond to blade edges of the impeller.

10. The assembly of claim 7, wherein the shroud is secured directly to the diffuser so as to cover the diffuser.

11. A shroud-diffuser assembly for a centrifugal compressor, the assembly comprising a shroud and a diffuser, one of the shroud and diffuser comprising a plurality of recesses and the other of the shroud and diffuser comprising a plurality of radial vanes, wherein the shroud is made to cover the diffuser such that each radial vane projects into a respective recess, wherein the diffuser comprises a hub, a perimeter wall, and a plurality of axial vanes that extend between the hub and the perimeter wall.

12. The assembly of claim 11, wherein the shroud comprises a curved downwardly-projecting edge, and the shroud is made to cover the diffuser such that the perimeter wall surrounds the downwardly-projecting edge.

13. A shroud for covering an impeller and a diffuser of a centrifugal compressor, the shroud comprising a bell-shaped wall having a central aperture, a first portion covering the impeller and a second portion covering the diffuser, wherein a surface of the first portion is contoured so as to correspond to blade edges of the impeller and a plurality of recesses are formed in a surface of the second portion, each recess dimensioned to receive a portion of a respective radial vane of the diffuser, wherein each radial vane is spaced axially from a wall of the respective recess, and wherein the shroud is spaced axially from the impeller by an amount smaller than the axial spacing between each radial vane and the wall of the respective recess.

14. The shroud of claim 13, wherein the second portion comprises a curved, downwardly-projecting edge.

15. A method of assembling a centrifugal compressor comprising:

providing an impeller, a diffuser and a shroud, one of the shroud and diffuser comprising a plurality of recesses and the other of the shroud and diffuser comprising a plurality of radial vanes;

covering the impeller and the diffuser with the shroud such that the shroud contacts the impeller and each radial vane projects into a respective recess; and separating the shroud from the impeller and the diffuser such that a clearance is defined between the shroud and the impeller and each radial vane continues to project into a respective recess.

16. The method of claim 15, wherein the shroud contacts blades of the impeller.

17. The method of claim 15, wherein the diffuser comprises a hub, a perimeter wall, and a plurality of axial vanes that extend between the hub and the perimeter wall, and the method comprises securing the shroud to the perimeter wall.

18. A shroud for covering an impeller and a diffuser of a centrifugal compressor, the shroud comprising a bell-shaped wall having a central aperture, a first portion covering the impeller and a second portion covering the diffuser, wherein a surface of the first portion is contoured so as to correspond to blade edges of the impeller and a plurality of recesses are formed in a surface of the second portion, each recess dimensioned to receive a portion of a respective radial vane of the diffuser, wherein the shroud comprises a support wall that extends upwardly from the bell-shaped wall, and a plurality of struts that extend between the support wall and the bell-shaped wall.

* * * * *